United States Patent [19]

Gosset et al.

[11] 4,441,937

[45] Apr. 10, 1984

[54] QUENCHING BATH AND QUENCHING METHOD FOR METALS

[75] Inventors: Serge Gosset, Lestrem; Michael Huchett, Merville, both of France

[73] Assignee: Roquette Freres, Lestrem, France

[21] Appl. No.: 515,466

[22] Filed: Jul. 20, 1983

[30] Foreign Application Priority Data

Jul. 23, 1982 [FR] France ..... 8212921

[51] Int. Cl.[3] ..... C21D 1/44; C21D 1/56

[52] U.S. Cl. ..... 148/18; 148/206; 148/27; 148/28; 148/30

[58] Field of Search ..... 148/18

[56] References Cited

U.S. PATENT DOCUMENTS

| | | | |
|---|---|---|---|
| 710,452 | 10/1902 | Greenman | 148/20.6 |
| 2,115,828 | 5/1938 | Prescott | 148/20.6 |
| 2,770,564 | 11/1956 | Gordon | 148/20.6 |
| 3,022,205 | 2/1962 | Chase et al. | 148/20.6 |
| 3,220,893 | 11/1965 | Blackwood et al. | 148/20.6 |
| 3,475,232 | 10/1969 | Lewis et al. | 148/20.6 |
| 3,526,551 | 9/1970 | Sargent | 148/20.6 |
| 4,192,764 | 3/1980 | Madsen | 427/304 |

OTHER PUBLICATIONS

Feiser & Feiser, Organic Chemistry, 3rd Ed. Reinhold Pub. Corp., pp. 389–390, 461, 475–476, 1956.

*Primary Examiner*—Veronica O'Keefe
*Attorney, Agent, or Firm*—Larson and Taylor

[57] ABSTRACT

Bath for the quenching of ferrous and nonferrous metals and their alloys, comprising a hydrogenated starch hydrolysate having, expressed with respect to the dry matter, a percentage of products of degree of polymerization 1 and 2 comprised between 1 and 90, the complement to 100 being constituted by products of degree of polymerization equal to or higher than 3.

8 Claims, 7 Drawing Figures

Figure 1:
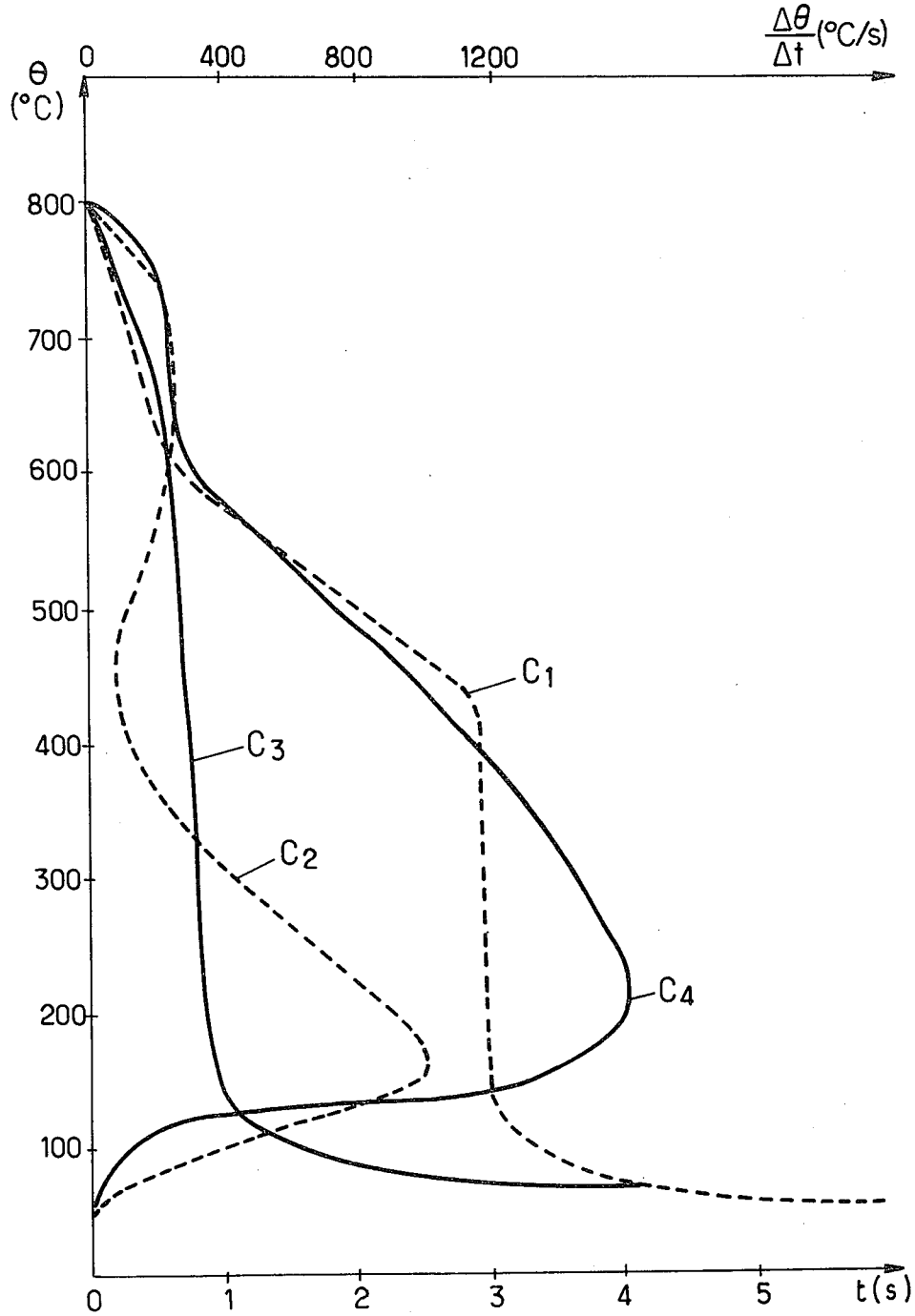

Δθ/Δt (°C/s)
θ (°C)
t (s)
C15
C16
C17
C18
C19
C20
200
400
600
800
1000
800
700
600
500
400
300
200
100
0
1
2
3
4
5
6
7
8
9
10

QUENCHING BATH AND QUENCHING METHOD FOR METALS

The present invention relates to an aqueous bath for the quenching of ferrous and non-ferrous metals and their alloys. It relates also to the method of quenching metals using said bath as well as the application to the quenching of metals of the constituents of the bath.

Search for high mechanical characteristics for certain metals or alloys leads to setting phases or crystallographic configurations which only exist at high temperatures or to obtaining phases or crystallographic configurations which can only be formed from the phase stable at high temperatures.

It is necessary for these reasons to carry out quenching in baths enabling this setting (or this transformation), that is to say in baths capable of cooling sufficiently rapidly the metal or the alloy previously brought within the temperature range wherein the desired structures are formed, so that these structures may be essentially preserved or transformed and diffusion phenomena due to gradual cooling avoided.

The transformation law may be expressed as follows: in order that quenching may occur, it is indispensable that before said cooling the critical point corresponding to the end of the transformation due to the heating should be exceeded and that the temperature of the metal should be such that it is entirely in the state stable at high temperature.

In the case of steel, it is the uniformity of distribution of the carbon produced when hot which must by set by the quenching. In its final quenched state, the metal is then characterized by a martensite (or bainite) structure.

To preserve the condition of maximum homogeneity in a metal, the cooling must be sufficiently fast. A limit is imposed by the fragility conferred on the quenched surface, which fragility increases at the same time as the hardness increases since too rapid cooling produces molecular tensions which lead to cracks and undesired distortions.

It may also be desired to seek, in the case of steel, as high as possible an elastic limit, allied to sufficient resilience. In the case of light alloys, the temperature zone corresponding to the desired structure, that is to say to the equilibrium point where the solubility of the different constituent elements is maximum, is sometimes comprised between limits separated very little from one another. After having brought the alloy to the temperature necessary for the production of the desired state, the quenching proper follows, that is to say a more or less rapid cooling according to the alloy and the type of part. The molecular distribution stable in the hot state is thus maintained in the cold, which permits the mechanical characteristics of the alloy to be modified advantageously. It follows that, according to the nature and the composition of the metals or alloys to be treated, the most suitable quenching methods and media for this operation are different. The liquids employed for quenching are for this reason very varied: cold water, water supplemented with sodium chloride or NaOH, lime water, acid liquors, hot water, petroleum, oils, tallow, and more recently water and polyvinyl alcohol, water and polyalkylene-glycols.

It results from the foregoing that quenching is a meticulous operation which requires many precautions. In particular suitable quenching baths should be used which are capable of varying speed of cooling within the desired limits in order to obtain the desired characteristics.

It was hence interesting to be able to find novel quenching baths, especially since the products used at present and recalled above are not devoid of drawbacks. In this respect there may be mentioned the corrosive action of salts and the high price of petroleum products.

Now, Applicant Company has made the meritorious discovery that the use in the quenching of ferrous, non-ferrous metals and their alloys, of a hydrogenated starch hydrolysate, having (the percentages being expressed as dry matter), a percentage of products of degree of polymerisation (DP) 1 and 2 comprised between 1 and 90%, the complement to 100% being constituted by products of degree of polymerisation equal or higher than 3, leads to particularly advantageous results and enables among other things modification of the cooling speed.

Consequently, the quenching bath according to the invention is characterized by a content of 0.2 to 80% by weight of said hydrolysate.

In addition, the quenching method according to the invention is characterized by the fact that said metals whose temperature is brought previously within the range corresponding to the desired structures, are immersed in an aqueous bath comprising from 0.2 to 80% by weight of said hydrogenated starch hydrolysate.

It is recalled that the starch may be hydrolysed, by the acid route, by the enzymatic route or by the mixed acid-enzymatic route, to different degrees, the degree of hydrolysis generally being characterized by the Dextrose-Equivalent (DE) defined as being the reducing power of the hydrolysate, expressed as D-glucose with respect to dry matter.

The more hydrolysed the starch, the higher is the DE, the ultimate stage of the hydrolysis corresponding in fact theoretically to a hydrolysate which would only contain dextrose. According to the method of hydrolysis used (type of enzymes for example) and according to the degree of hydrolysis, it is possible to obtain starch hydrolysates of different DE and having a very varied distribution of products of different degrees of polymerisation: glucose (DP 1), maltose and isomaltose (DP 2), maltotriose (DP 3), oligosaccharides and polysaccharides.

The starch hydrolysates of varied composition so obtained can then be hydrogenated, in a manner known in itself, generally at high hydrogen pressures and at high tempertures and in the presence of catalysts such as, for example, Raney nickel. The various sugars constituting the starch hydrolysates are thus converted into the corresponding polyols.

The hydrogenated starch hydrolysate used for the constitution of the aqueous quenching baths according to the invention have a percentage of reducing sugars less than 5% (percentage expressed on dry matter of the hydrolysate), preferably less than 2% and more preferably still less than 0.5%.

Preferably, the hydrogenated starch hydrolysate used according to the invention has a percentage of products of DP 1 and DP 2 comprised between 2 and 75%, and more preferably again comprised between 2 and 65%, the complement to 100 being constituted by products of DP higher than or equal to 3.

The preferred hydrogenated starch hydrolysates are obtained by the hydrogenation of starch hydrolysates the DE of which is comprised between 15 and 70.

In the rest of the description, the hydrogenated starch hydrolysate will be denoted by the abbreviation HSH.

The advantageous properties conferred on aqueous quenching baths by the use according to the invention of the above said HSH, have been established by study of the development of the temperature of the quenched specimen as a function of time (namely $\theta = f(t)$) as well as by study of the development of the cooling speed of the quenched specimen as a function of time $$\left(\text{namely } \frac{\Delta\theta}{\Delta t} = g(t)\right)$$

or as a function of temperature $$\left(\text{namely } \frac{\Delta\theta}{\Delta t} = f(\theta)\right).$$

Thus it has been possible to show particularly that the quenching bath according to the invention had performances notably higher than those of aqueous quenching baths of the prior art comprising polyhydric alcohols selected from the group constituted by sorbitol, mannitol, maltitol and lactitol. These baths had previously been considered satisfactory.

The properties of the quenching bath according to the invention vary according to the concentration selected for HSH.

Thus, according to the concentration used, it is possible to obtain an accelerating effect of the quench or a retarding effect of the quench with respect to the quench obtained with water alone.

Baths having an accelerator effect contain from 0.2 to 40% and preferably from 0.5 to 35% by weight of HSH.

Baths having a retarding effect on the cooling speed compared to water contain from 40 to 80%, preferably from 40 to 75% of HSH.

It is in the acceleration of the cooling speed with respect to quenching in water that the use of the above-said hydrogenated starch hydrolysate according to the invention reveals itself as most advantageous. The accelerator effect obtained is in fact as good, even superior to, that obtained with inorganic salts used heretofore.

In addition, a determining advantage resides in the fact that the accelerator effect conferred on the bath by use according to the invention of the above-said HSH is substantially constant in a relatively extended zone of concentrations comprised approximately between 3 and 25% by weight, whence excellent safety of operation is obtained despite the phenomena of evaporation or exhaution of the baths. This is not in fact always the case for quenching baths of the prior art containing inorganic salts, for which the variations in concentration have much more sensitive effects.

The quenching bath according to the invention, comprising from 0.2 to 80% of HSH, may be used at temperatures varying particularly from 4 to 60° C., preferably from 4° to 50° C. and, more preferably still, from 10° to 45° C.

The HSH applied according to the invention to the constitution of the quenching bath according to the invention, not only modifies as indicated above, the cooling speed of the quenched metals, but has in addition other advantages. Firstly, it has no aggression with respect to metals and their alloys and may even, on the contrary, have a protective effect on the surfaces. It avoids in particular the granular corrosion of aluminum alloys, which corrosion is formed particularly in quenching baths containing compounds of inorganic origin like sodium or potassium derivatives whose aggression with respect to both to ferrous alloys and to light alloys is considerable.

More particularly and still in the case of aluminum and its alloys, the hardness conferred on the parts treated according to the invention is higher than that of parts treated conventionally, for example, by water quenching.

Another advantage resides in the non-toxicity of the hydrogenated starch hydrolysates employed according to the invention, in their complete biodegradability as well as in their non-inflammability.

According to a particular aspect of the present invention and particularly to act on the cooling speed, it is possible to add to the hydrogenated starch hydrolysate one or several oxyanion salts selected particularly from the group of boron, tin, germanium, tellurium or arsenic, these salts being capable of forming with the hydrogenated starch hydrolysate complexes soluble in water.

The preferred oxyanion is constituted by boron, and the salts used preferentially are the borates.

These oxyanion salts, when they are used, may be added within a fairly wide range of concentrations, limited in practice by their water solubility limit. Preferably however, the ratio HSH (dry matter)/salt is selected to be between 100/1 and 1/2, and more preferably between 30/1 and 1/1.

Preferably, these salts are dissolved in the hydrogenated starch hydrolysate and they are allowed to react with the latter prior to the constitution of the baths.

The quenching bath according to the invention can contain in addition various adjuvants such as antioxidant agents, anti-corrosion agents, bactericidal agents and the like. It is possible also to envisage adding to it products already known for their properties of modifying the cooling speed of the metals, in order to optimise, if necessary, its performances.

The invention will be in any case better understood by means of the examples which follow:

EXAMPLE 1

In order to study the performances of the quenching bath according to the invention and in order to compare it with that of certain baths used at present, drasticity measurements have been made according to the operational method described below.

A CETIM drasticimeter (Centre Technique des Industries Mecaniques SENLIS-FRANCE) constituted by a silver cylinder of revolution, of diameter equal to 8 mm and length equal to 24 mm, is brought to a temperature of 800° C. and is then plunged suddenly into an unstirred quenching bath of 200 $cm^3$. At the moment when the drasticimeter or detector is plunged into the bath, the temperature $\theta$ (in °C.) starts to be recorded as a function of time t (in seconds) and the curve $\theta = f(t)$ is plotted.

The curve $$\frac{\Delta\theta}{\Delta t} = f(\theta)$$

is also plotted; this curve represents the development of the cooling speed $$\frac{\Delta\theta}{\Delta t}$$

(in °C. per second) as a function of temperature 0.

First a control curve is produced with a bath constituted only by distilled water, at a temperature of 30° C.

The two curves $\theta = f(t)$ and $$\frac{\Delta\theta}{\Delta t} = f(\theta)$$

obtained are shown at FIG. 1 at $C_1$ and $C_2$ respectively.

Examination of these graphs shows that cooling by distilled water results in considerable irregularities.

In addition, it is stressed that the transition points between the calefication, boiling and convection zones may be totally different from one measurement to another, which illustrate well the instability and the lack of reproducibility of cooling in distilled water, possible causes, obviously, of considerable heterogeneities at the level of hardness of parts.

The same drasticity measurements were carried out, under the same conditions as previously, the quenching fluid then being constituted by a 5% dry matter solution of a hydrogenated starch hydrolyate (HSH 1) in distilled water.

This hydrolyate HSH 1 was prpared from a starch hydrolysate of which the DE before hydrogenation was equal to 55 and which itself had previously been prepared by double enzymatic hydrolysis, with α-amylase and then with β-amylase.

The percentage of reducing sugars of the hydrolyste HSH 1 is less than 0.20 and its composition (in % dry matter) as follows:

| | | |
|---|---|---|
| DP | 1 | 7.0 |
| DP | 2 | 52.5 |
| DP | 3 | 18.0 |
| DP | 4 | 1.0 |
| DP | 5 | 1.7 |
| DP | 6 | 2.4 |
| DP | 7 | 4.0 |
| DP | 8 | 2.8 |
| DP | 9 | 0.8 |
| DP | ≧10 | 9.8 |
| | | 100.0 |

The curves $\theta = f(t)$ and $$\frac{\Delta\theta}{\Delta t} = f(\theta)$$

recorded with the quenching bath based on HSH 1 hydrolysate are shown in FIG. 1 at $C_3$ and $C_4$ respectively.

Comparison of the curves $C_1$ and $C_2$ with the curves $C_3$ and $C_4$ enables it to be observed that the presence of HSH leads to a very distinct acceleration of the cooling speed in the course of quenching.

EXAMPLE 2

This example is a comparative example of the performances obtained with the hydrolysate HSH 1 and two other hydrogenated hydrolysates HSH 2 and HSH 3, prepared by hydrogenation of starch hydrolysates of different composition having before hydrogenation a DE of 33 and 30 respectively.

The composition of hydrolysates HSH 2 and HSH 3 was as follows:

| | | HAH 2 | HAH 3 |
|---|---|---|---|
| DP | 1 | 6.5 | 14.3 |
| DP | 2 | 26 | 9 |
| DP | 3 | 20 | 12 |
| DP | 4 | 10 | 6.9 |
| DP | 5 | 7 | 10.1 |
| DP | 6 | 3 | 13.0 |
| DP | 7 | 3 | 3.7 |
| DP | 8 | 2 | 2 |
| DP | 9 | 1 | 2 |
| DP | ≧10 | 21.5 | 27 |
| | | 100.0 | 100.0 |

The percentage of reducing sugars (on d.m.=dry matter) of the hydrolysates HSH 2 and HSH 3 was less than 0.20.

The conditions of the tests were identical with those of Example 1, the quenching baths tested containing respectively 5% of each of HSH 1, 2 and 3 and their temperature being 30° C.

Figure 2:
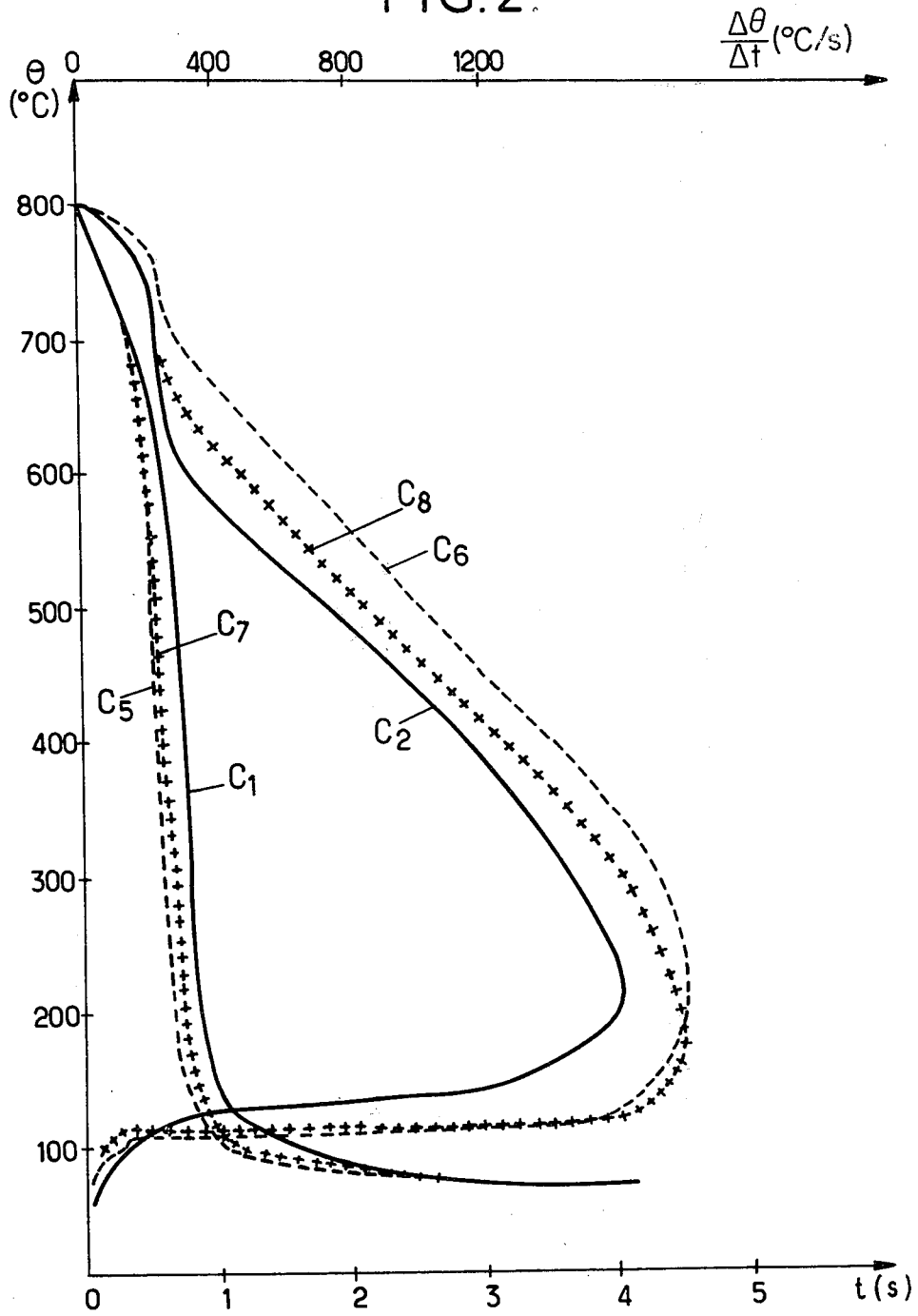

The results obtained are represented by the graphs $C_1$, $C_2$ (HSH 1), $C_5$, $C_6$ (HSH 2) and $C_7$, $C_8$ (HSH 3) shown in FIG. 2.

It is observed, in examining these curves, that the three hydrogenated starch hydrolysates enable a notable acceleration in the cooling speed.

It is also observed that the acceleration obtained with HSH 2 (DE before hydrogenation=33), is more accentuated than that obtained with HSH 1 (DE before hydrogenation=55).

Comparison of the curves obtained with hydrolysates HSH 2 and HSH 3 shows that the acceleration obtained with the hydrolysate prepared from a DE of 30 (HSH 3) is less considerable than that obtained with that prepared from DE 33 (HSH 2).

This observation establishes the importance of the presence and the distribution of the hydrogenated oligosaccharides and polysaccharides in the hydrolysates applied according to the invention and enables the properties of the quenching bath to be varied by causing the distribution of the HSH in products of different degrees of polymerisation to be varied, which is made possible by present advances in the technology of starch hydrolysis, particularly enzymatically.

EXAMPLE 3

This example was carried out to compare the performances recorded for the acceleration of the cooling speed, on one hand in the case of a quenching bath according to the invention and, on the other hand in the case of two quenching baths according to the prior art.

The quenching bath according to the invention was constituted by a 5% d.m. solution of the hydrolysate HSH 2 in distilled water.

The two quenching baths of the prior art were constituted by:

an aqueous solution of sorbitol with 5% of d.m., an aqueous solution of sodium salts with 5% of d.m. The temperature of the three baths was 30° C.

Figure 3:
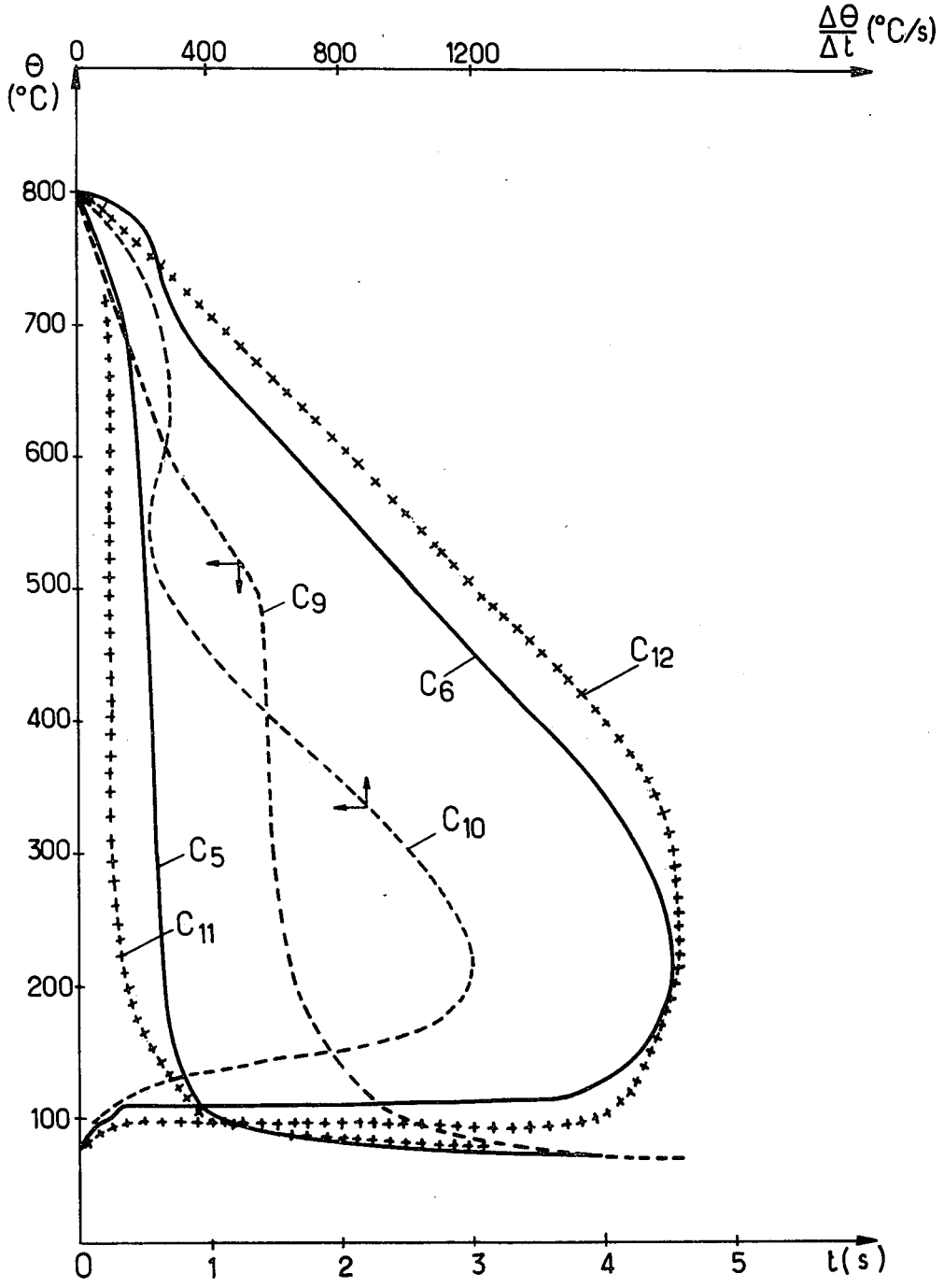

In FIG. 3, are shown the drasticity curves obtained, namely:

| | |
|---|---|
| bath with HSH 2 | $C_5$ and $C_6$ |
| bath with sorbitol | $C_9$ and $C_{10}$ |
| bath with sodium salts | $C_{11}$ and $C_{12}$. |

It is observed that the hydrolysate HSH 2:

has a much greater and a much more regular effect on the cooling speed than sorbitol can have, has performances very substantially equivalent to those of baths containing inorganic salts.

EXAMPLE 4

In this example, the performances obtained in the case of the hydrolysate HSH 3 were compared with those obtained in the case of the same hydrolysate in which borax had previously been dispersed in a proportion of 10% of borax decahydrate (percentage expressed in material as such on dry matter of the hydrolysate).

As in the preceeding examples, the quenching baths were at a concentration of 5% of d.m. and at a temperature of 30° C.

Figure 4:
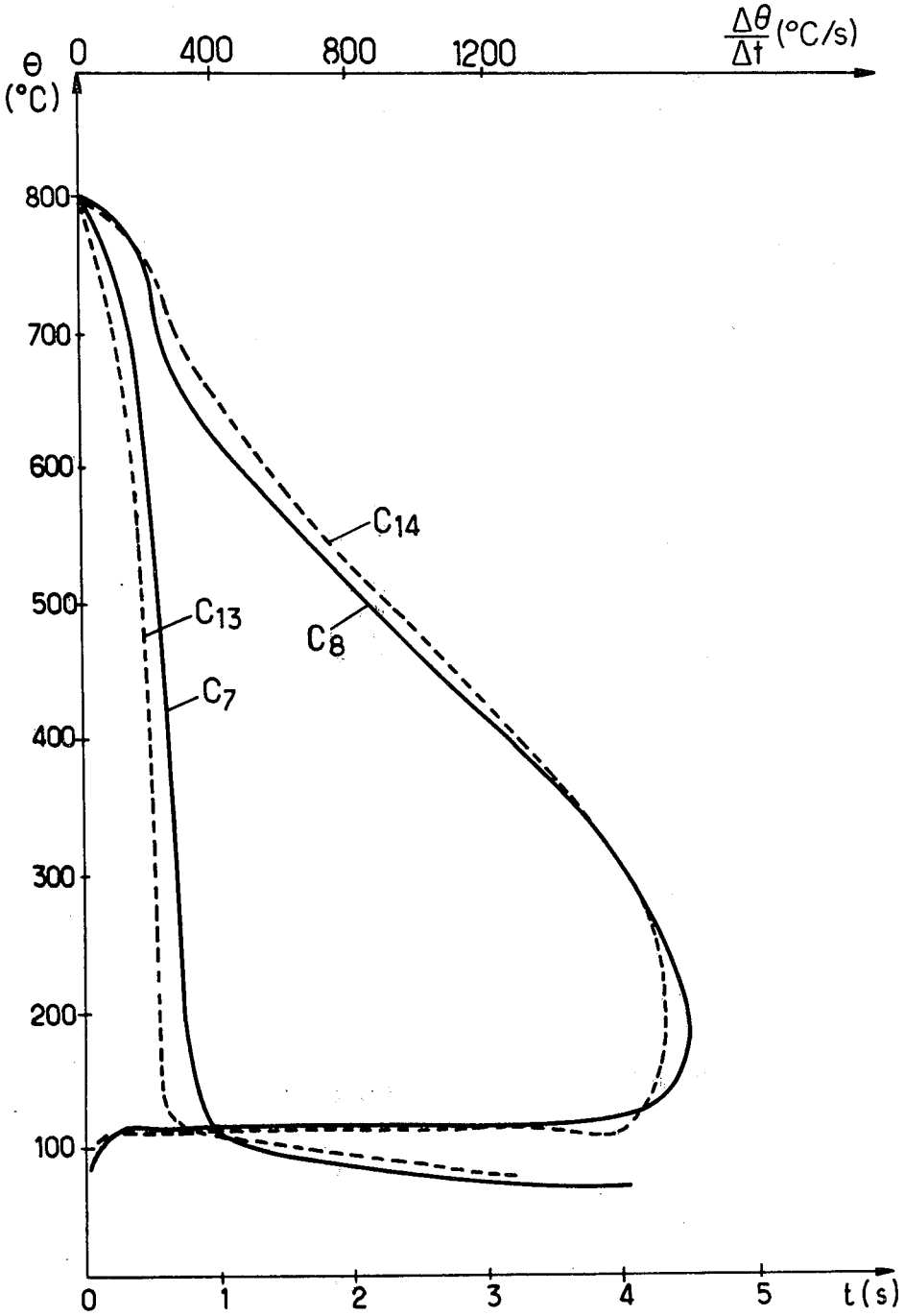

In FIG. 4, are shown the drasticity curves obtained, namely:

| | |
|---|---|
| bath with HSH 3 alone | $C_7$ and $C_8$ |
| bath with HSH 3 plus borax | $C_{13}$ and $C_{14}$. |

It is observed that the addition of borax slightly modifies the cooling speed obtained by means of the hydrolysate alone.

EXAMPLE 5

In this example, the influence on the speed of quenching of the concentration in hydrolysate of the quenching baths according to the invention was studied.

This study was motivated by the fact that, under industrial operating conditions, this parameter varies easily as a result, for example, of evaporation.

Drasticity curves were therefore established in the same way as previously with quenching baths containing respectively 5%, 10% and 20% (in dry matter) of the hydrolysate HSH 3.

Figure 5:
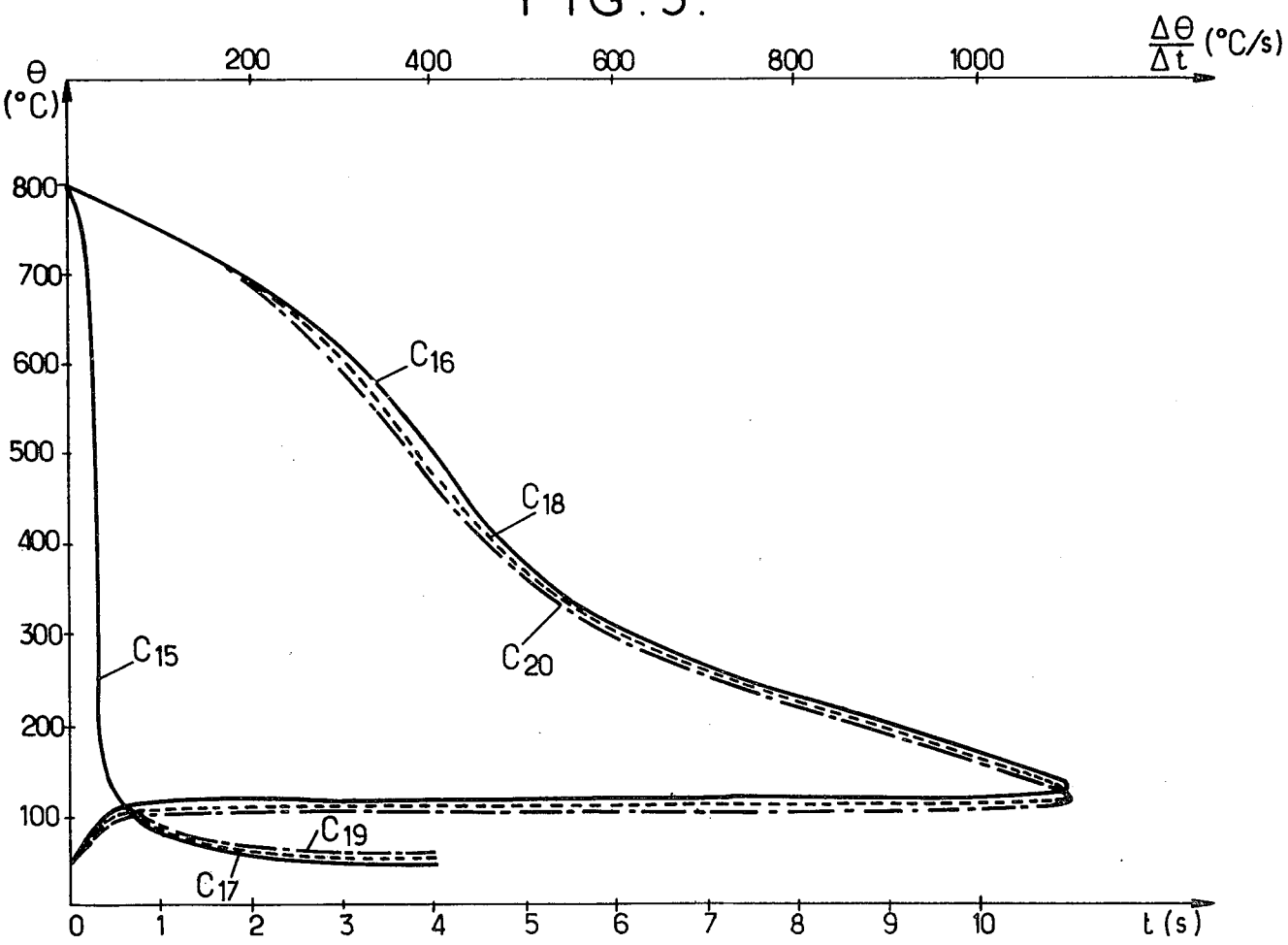

In FIG. 5, are shown the curves obtained, namely:

| | |
|---|---|
| bath with 5% of HSH 3 | $C_{15}$ and $C_{16}$ |
| bath with 10% of HSH 3 | $C_{17}$ and $C_{18}$ |
| bath with 20% of HSH 3 | $C_{19}$ and $C_{20}$. |

It is seen that the variations of the concentration between 5% and 20% of dry matter only cause a very slight variation in the shape of the curves.

This constitutes a determining advantage of the quenching bath according to the invention since their performances will be little sensitive to evaporation and to the consequential variations in the concentration.

EXAMPLE 6

It is certain that the temperature of a quenching bath can be maintained at around 30° C., but in reality the variations can range from a temperature of about 10° C., for a "fresh" quenching bath to about 60° C. for a much used quenching bath if inergetic regulation of the temperature is not resorted to.

By proceeding still in the same manner and by using the hydrolysate HSH 3, drasticity measurements were carried out at bath temperatures of 20° C., 40° C., 50° C. and 60° C., the bath having a concentration of 5% of dry matter.

Figure 6:
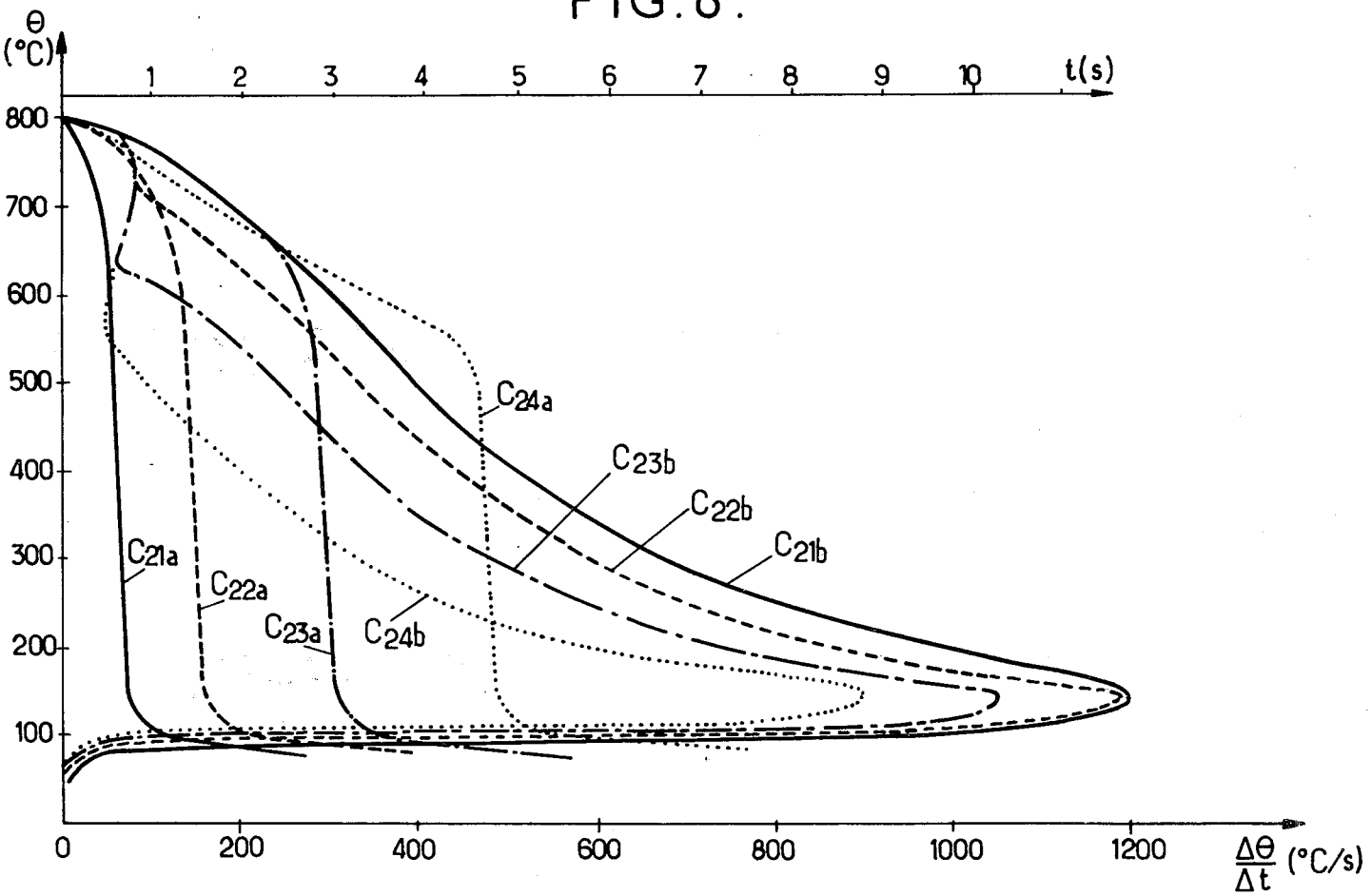

There are shown on FIG. 6, the results illustrated by the curves:

$$C_{21a}\,[\theta = f(t)] \text{ and } C_{21b}\left[\frac{\Delta\theta}{\Delta t} = f(\theta)\right] \text{ at } 20^\circ \text{ C.}$$

$$C_{22a}\,[\theta = f(t)] \text{ and } C_{22b}\left[\frac{\Delta\theta}{\Delta t} = f(\theta)\right] \text{ at } 40^\circ \text{ C.}$$

$$C_{23a}\,[\theta = f(t)] \text{ and } C_{23b}\left[\frac{\Delta\theta}{\Delta t} = f(\theta)\right] \text{ at } 50^\circ \text{ C.}$$

$$C_{24a}\,[\theta = f(t)] \text{ and } C_{24b}\left[\frac{\Delta\theta}{\Delta t} = f(\theta)\right] \text{ at } 60^\circ \text{ C.}$$

It is observed that from about 40° C. a calefaction zone appears. At 50° and 60° C., a more and more marked retarding effect appears.

It is hence preferable to regulate the temperature of the accelerator bath so that is does not rise too much above 40° C.

EXAMPLE 7

This example is for the purpose of illustrating the advantages contributed by the use of the bath according to the invention within the scope of their application to the quenching of parts of aluminum or alloys of this metal.

The hydrogenated starch hydrolysate used corresponds to that identified in the Example 2 by HSH 3.

It is used at a concentration of 4.5% expressed in dry matter in water.

The parts treated by the so called potting method are parts cast in aluminum alloy of the type AU 5 GT.

The bath is at ambient temperature.

To arrange so that the temperature of the parts is uniform throughout their thickness at the moment of quenching, they are maintained before quenching at a temperature of 525° C. for a sufficient period of about three hours.

The period of immersion is 8 minutes.

The hardness passes, due to this quenching, from a non uniform value of 70–78 BH (Brinnel Hardness, standard P:10 D2) before quenching to a homogeneous value of 90–94 BH after quenching.

It is recalled that the hardness generally required for quenched parts is at least 80 BH, which value is only just obtained by conventional quenching with water.

EXAMPLE 8

This example is for the purpose of illustrating the retarding effect shown by the baths according to the invention when their concentration is high.

The drasticity curves (respectively speed of cooling and development of temperature) obtained with distilled water on the one hand are compared with quenching baths with 50% of d.m. based on hydrolysate HSH 3 without and then with borax as described in Example 4 on the other hand.

The temperature of the baths was still 30° C.

Figure 7:
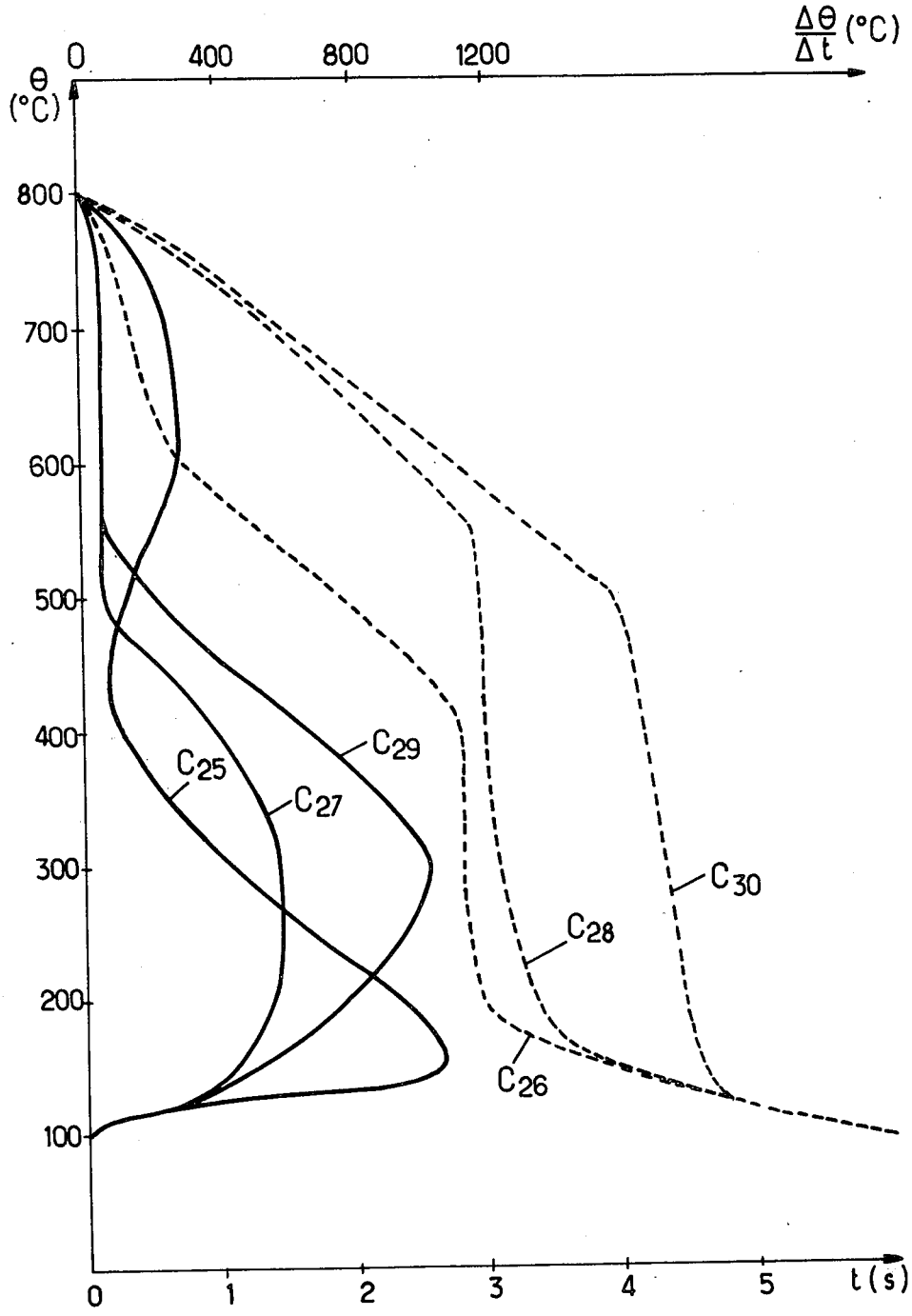

On FIG. 7 are shown the curves obtained, namely:

$C_{25}$ and $C_{26}$ for distilled water $C_{27}$ and $C_{28}$ for HSH 3

$C_{29}$ and $C_{30}$ for borated HSH 3.

On examining these graphs, it is observed that:

the development of the temperature as a function of time clearly establishes the retarding action of hydrolysate HSH 3, particularly in the calefaction zone, the action of the borax is to notably reduce the cooling speed in the second part of the curve, namely essentially between about 550° and 100° C.

As is self-evident and as results already from the foregoing, the invention is in no way limited to the types of application and embodiments which have been more particularly envisaged; it encompasses, on the contrary, all modifications.

We claim:

1. A method of quenching a metal selected from the group consisting of ferrous and non-ferrous metals and their alloys which comprises quenching said metal with an aqueous quenchant bath comprising an aqueous solution of an hydrogenated starch hydrolysate having, expressed with respect to the dry matter, a percentage of products of degree of polymerisation 1 and 2 comprised between 1 and 90, the complement to 100 being constituted by products of degree of polymerisation equal or higher than 3, the concentration of said aqueous solution in hydrolysate being from 0.2 to 80% by weight.

2. A method according to claim 1, wherein the hydrogenated starch hydrolysate has a percentage of reducing sugars less than 5%, preferably less than 2% and, more preferably still, less than 0.5%.

3. A method according to claim 1 wherein the hydrogenated starch hydrolysate has a percentage of products of degree of polymerisation 1 and 2 comprised between 2 and 75, preferably between 2 and 65, the complement to 100 being constituted by products of degree of polymerisation higher than or equal to 3.

4. A bath for the quenching of ferrous or non-ferrous metals and of their alloys, comprising an aqueous solution of a hydrogenated starch hydrolysate having, expressed with respect to the dry matter, a percentage of products of degree of polymerisation 1 and 2 comprised between 1 and 90, the complement to 100 being constituted by products of degree of polymerisation equal or higher than 3, the concentration of said aqueous solution in hydrolysate being from 0.2 to 80% by weight.

5. A bath according to claim 4, with an accelerating effect on the cooling speed, containing from 0.2 to 40%, preferably from 0.5 to 35% by weight of hydrogenated starch hydrolysate.

6. A bath according to claim 4, with a retarding effect on the cooling speed, containing from 40 to 80%, preferably from 40 to 75% of hydrogenated starch hydrolysate.

7. A bath according to claim 4, containing, besides the hydrogenated starch hydrolysate, at least one oxyanion salt selected from the group comprising boron, tin, germanium, tellurium and arsenic.

8. Method of quenching ferrous or non-ferrous metals and their alloys, comprising immersing the metal previously brought to a temperature at which it has the desired structure in an aqueous bath according to claim 4 and of which the temperature is from 10° to 60° C.

* * * * *